US005415103A

United States Patent [19]

Radermacher

[11] Patent Number: 5,415,103

[45] Date of Patent: May 16, 1995

[54] PROGRAMMABLE MUNITIONS DEVICE

[75] Inventor: Andreas Radermacher, Moosburg, Germany

[73] Assignee: Texas Instruments Incorporated, Dallas, Tex.

[21] Appl. No.: 291,965

[22] Filed: Aug. 17, 1994

[51] Int. Cl.[6] ..... F42C 17/00; B23Q 21/00

[52] U.S. Cl. ..... 102/427; 102/215; 102/270

[58] Field of Search ..... 89/6, 6.5; 102/200, 102/206, 215, 270, 427

[56] References Cited

U.S. PATENT DOCUMENTS

| | | | |
|---|---|---|---|
| 3,500,746 | 3/1970 | Ambrosini | 102/206 |
| 4,053,774 | 10/1971 | Schuermann et al. | 342/44 |
| 4,333,072 | 6/1982 | Beigel | 340/825.54 |
| 4,576,093 | 3/1986 | Snyder | 102/200 |
| 4,884,506 | 12/1989 | Guerreri | 102/200 |
| 5,041,826 | 8/1991 | Milheiser | 340/825.54 |
| 5,136,949 | 8/1992 | Grosch | 102/215 |
| 5,343,795 | 9/1994 | Ziemba et al. | 89/6.5 |

*Primary Examiner*—Charles T. Jordan
*Assistant Examiner*—Theresa M. Wesson
*Attorney, Agent, or Firm*—James C. Kesterson; Richard L. Donaldson

[57] ABSTRACT

A programmable munitions device (10) includes a transponder unit (12), a digital interface (18), and munitions unit (20). The transponder unit (12) receives a radio frequency signal from an interrogation unit (22). The transponder unit (12) decodes the radio frequency signal to obtain the digital data representing the transmitted information from the interrogation unit (22). The information is stored within a memory (14) and initiates the start of a time period within a timing unit (16). Upon activation, the munitions unit (20) reads the information within the memory (14) and a timing flag within the timing unit (16) through the digital interface (18). If the timing flag is set, indicating that the information within memory (14) is still fresh, munitions unit (20) causes the detonation of explosive material if the recognized event corresponds to the triggering event programmed within the memory (14). If the timing flag is cleared, indicating that the information programmed within the memory (14) is stale, the munitions unit (20) reverts to default settings within the digital interface (18) in determining whether the recognized event corresponds to the default settings.

8 Claims, 1 Drawing Sheet

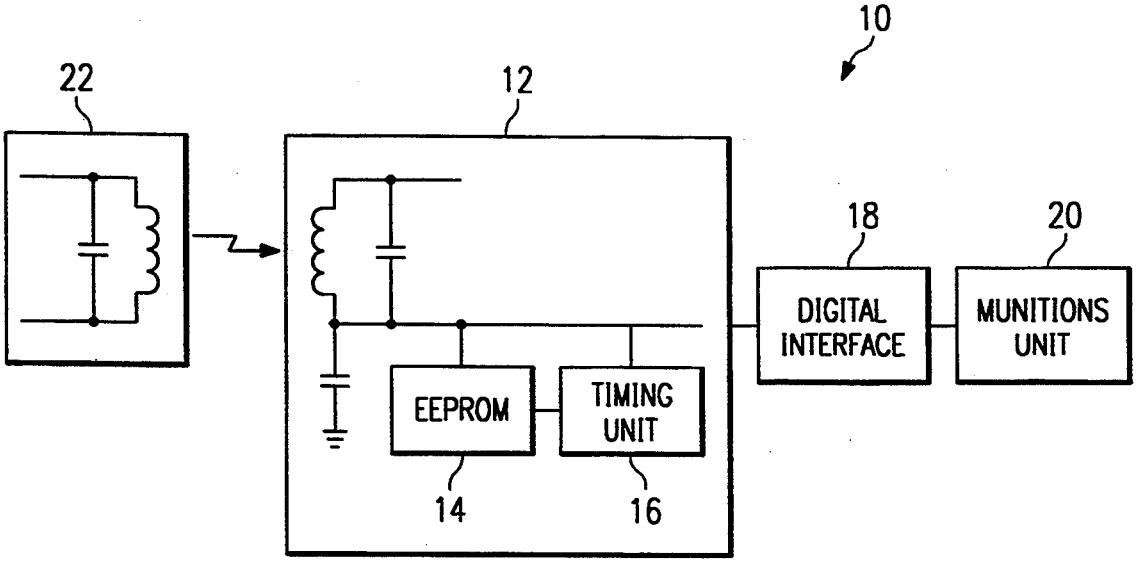
10
22
12
18
20
DIGITAL INTERFACE
MUNITIONS UNIT
EEPROM
TIMING UNIT
14
16

PROGRAMMABLE MUNITIONS DEVICE

TECHNICAL FIELD OF THE INVENTION

The present invention relates in general to explosive materials and more particularly to a programmable munitions device.

BACKGROUND OF THE INVENTION

Certain munitions such as land mines can be programmed to detonate in response to a specific event. For example, land mines can be programmed to distinguish between a truck and a tank. Further, the land mine can be programmed to detonate after recognition of a first, second, third, or any number of specific vehicles. Remote communication may be performed with certain mines for activation and deactivation. To prepare the communication hardware for operation, the device needs to be programmed according to frequency, time, and channel. Mines have a sophisticated protection mechanism to allow troops to handle them and program them in a field environment. However once the mine has been positioned, the mine cannot be reprogrammed without physically recovering the mine. Land mines typically have to be programmed before they are deployed to their fixed positions. Further, the programming of munitions has to be performed before any energy, e.g., from an embedded battery, is available within the munition. Therefore, it is desirable to program land mines without using munitions provided power.

SUMMARY OF THE INVENTION

From the foregoing, it may be appreciated that a need has arisen for programming of munitions. A need has also arisen for a munitions device that can be programmed.

In accordance with the present invention, a programmable munitions device is provided that substantially eliminates or reduces disadvantages and problems associated with conventional munitions devices.

According to an embodiment of the present invention, there is provided a programmable munitions device that includes a transponder unit operable to receive a radio frequency programming signal wherein said radio frequency programming signal supplies power and information to the transponder unit without requiring munitions provided power. A digital interface unit is coupled to the transponder unit and is operable to retrieve the information stored in the transponder unit. A munitions unit reads the information retrieved by the digital interface unit and stores the information for use whenever the munition is activated.

The present invention provides various technical advantages over conventional munitions devices. For example, one technical advantage is in programming a munitions device to detonate after the occurrence of a specific event. Another technical advantage is in programming a munitions device without the need of any energy from the munition, thereby maintaining the munition in a safe condition. Other technical advantages are readily apparent to one skilled in the art from the following figures, descriptions, and claims.

BRIEF DESCRIPTION OF THE DRAWINGS

For a more complete understanding of the present invention and the advantages thereof, reference is now made to the following description taken in conjunction with the accompanying drawing, wherein like reference numerals represent like parts, in which:

The figure illustrates a block diagram of a programmable munitions device.

DETAILED DESCRIPTION OF THE. INVENTION

The figure is a block diagram of a programmable munitions device 10. Programmable munitions device 10 includes a transponder unit 12 having a memory 14 and a timing unit 16. Transponder unit 12 is coupled to a digital interface 18 that allows access to transponder unit 12 by a munitions unit 20. Transponder unit 12 receives information from a remote interrogator unit 22. Further information on transponder unit 12 and interrogator unit 22 can be found in U.S. Pat. No. 5,053,774 issued Oct. 1, 1991, entitled "Transponder Arrangement" and hereby incorporated by reference herein.

In operation, programmable munitions device 10 can be remotely programmed from an interrogator unit 22 through the transfer of information by radio frequency signals. Transponder unit 12 receives a radio frequency signal from interrogation unit 22 and derives the necessary information from the radio frequency signal for storage into memory 14. Digital information is typically determined from the radio frequency signal through amplitude modulation in order to determine the binary zero and binary one values of data bits for the transmitted information.

The information that transponder unit 12 receives from interrogation unit 22 is the programming data used by programmable munitions device 10 in determining when detonation of the connected explosive material is to occur. The programming information received by transponder unit 12 is stored within memory 14. Memory 14 is preferably an electrically erasable programmable read only memory.

A timing unit 16 is coupled to memory 14 and is used in determining the freshness of the data within memory 14. Timing unit 16 establishes a fixed time period from when memory 14 has been programmed. If the munitions device is activated within the fixed time established in unit 16, the munitions electronic will read via the digital interface 18 the programmed information and behave accordingly. If the time period established by timing unit 16 has elapsed, then programmable munitions device 10 will revert to default settings in order to determine whether detonation should occur.

Digital interface 18 provides the communication of programmed information from transponder unit 12 to munitions unit 20. Upon activation, munitions unit 20 consults digital interface 18 in order to analyze the programmed information within memory 14 of transponder unit 12. Digital interface 18 checks timing unit 16 to see if a timing flag has been set. A set timing flag indicates that programmed information within memory 14 has been received within the time period established by timing unit 16 for controlling operation of programmable munitions device 10. If the timing flag is cleared, the information within memory 14 is stale and programmable munitions device 10 is under the control of fixed default settings within digital interface 18. Once programmable munitions device 10 has been placed in a field environment, programming may occur without disturbing the placement of programmable munitions device 10 by remote programming through interrogator unit 22.

In summary, a programmable munitions device can be placed in a field environment and subsequently programmed without disturbing the location of the programmable munitions device and without activating the munitions power. The programmable munitions device includes a transponder unit that receives information from a remote interrogation unit and stores the programming information within a memory. A munitions unit reads the programming information within the memory through a digital interface to determine whether a recognized event has occurred for detonation of the programmable munitions device. The transponder unit also includes a timing unit that establishes the freshness of the programmable information within the memory. The programmable munitions device reverts to default settings when information within the memory has been in place beyond the time period established by the timing unit.

Thus, it is apparent that there has been provided, in accordance with the present invention, a programmable munitions device that satisfies the advantages set forth above. Although the preferred embodiment has been described in detail, it should be understood that various changes, substitutions, and alterations can be made herein without departing from the spirit and scope of the present invention as defined by the following claims.

What is claimed is:

1. A device for programming munitions detonation, comprising:

a transponder unit operable to receive a radio frequency programming signal, said radio frequency programming signal supplying power and information to said transponder unit, said information being stored in said transponder unit;

a digital interface unit coupled to said transponder unit and operable to retrieve said information stored in said transponder unit, said digital interface unit further operable to store default information; and a munitions unit coupled to said digital interface unit and operable to detonate explosive material in response to said information stored in said transponder unit.

2. The device of claim 1, further comprising:

an interrogation unit operable to generate said radio frequency programming signal.

3. The device of claim 1, further comprising:

a timing unit coupled to said transponder unit and operable to set a flag signal in response to a receipt of said radio frequency programming signal by said transponder unit.

4. The device of claim 3, wherein said timing unit clears said flag signal after a selected time interval.

5. The device of claim 3, wherein said munitions unit operates according to said information stored in said transponder unit when said flag signal is set.

6. The device of claim 4, wherein said munitions unit operates according to default information when said flag signal is clear.

7. The device of claim 1, wherein said transponder unit is operable to receive a subsequent radio frequency programming signal and store subsequent information provided by said subsequent radio frequency programming signal.

8. The device of claim 3, wherein said transponder unit is operable to receive a subsequent radio frequency programming signal and store subsequent information provided by said subsequent radio frequency programming signal and said timing unit operable to reset said flag signal in response to receipt of said subsequent radio frequency programming signal.

* * * * *